US011408289B2

(12) United States Patent
Pöhler et al.

(10) Patent No.: US 11,408,289 B2
(45) Date of Patent: Aug. 9, 2022

(54) MOVING BLADE OF A TURBO MACHINE

(71) Applicant: MAN Energy Solutions SE, Augsburg (DE)

(72) Inventors: Thorsten Pöhler, Dinslaken (DE); Dirk Frank, Voerde (DE)

(73) Assignee: MAN ENERGY SOLUTION SE, Augsburg (DE)

( * ) Notice: Subject to any disclaimer, the term of this patent is extended or adjusted under 35 U.S.C. 154(b) by 0 days.

(21) Appl. No.: 16/821,322

(22) Filed: Mar. 17, 2020

(65) Prior Publication Data

US 2020/0318485 A1 Oct. 8, 2020

(30) Foreign Application Priority Data

Apr. 4, 2019 (DE) ..... 10 2019 108 811.9

(51) Int. Cl.
*F01D 5/18* (2006.01)
*F01D 5/30* (2006.01)

(52) U.S. Cl.
CPC ..... *F01D 5/18* (2013.01); *F01D 5/187* (2013.01); *F01D 5/30* (2013.01); *F05D 2260/221* (2013.01)

(58) Field of Classification Search
CPC ..... F01D 5/186; F01D 5/187
See application file for complete search history.

(56) References Cited

U.S. PATENT DOCUMENTS 9,181,807 B2 * 11/2015 Kuwabara ..... F01D 5/186
9,518,468 B2 * 12/2016 Tibbott ..... F01D 9/06
9,664,051 B2 * 5/2017 Bluck ..... F01D 5/187
10,174,622 B2 * 1/2019 Zhang ..... F01D 5/187
2005/0152785 A1 * 7/2005 McGrath ..... F01D 5/187 416/97 R
2007/0020100 A1 1/2007 Beeck et al.
2012/0163995 A1 6/2012 Wardle et al.
(Continued)

FOREIGN PATENT DOCUMENTS

EP 2 489 838 8/2012
EP 2700787 2/2014
WO WO 2019002274 1/2019

OTHER PUBLICATIONS

Office Action of corresponding German Patent Application No. 10 2019 108 811.9.

(Continued)

*Primary Examiner* — Justin D Seabe
(74) *Attorney, Agent, or Firm* — Cozen O'Connor

(57) ABSTRACT

A moving blade of a turbo machine, having a leading edge, a flow trailing edge, flow conduction faces, and a blade root mounting the moving blade to a hub body. The blade root is fir tree-like with projections spaced apart from one another. An inner shroud is arranged between the blade leaf and the blade root. A cooling passage is integrated in the blade leaf and the blade root for a cooling medium. An inlet of the cooling passage is formed on the blade root formed of a first inlet passage portion and a second inlet passage portion and a material web extends there between. The first inlet passage portion and the second inlet passage portion merge into a unifying passage portion arranged radially outside the uppermost projection of the blade root and radially inside of the inner shroud.

14 Claims, 3 Drawing Sheets

(56) References Cited

U.S. PATENT DOCUMENTS

| | | | | |
|---|---|---|---|---|
| 2012/0171046 | A1* | 7/2012 | Boyer | F01D 5/18 416/97 R |
| 2012/0269649 | A1* | 10/2012 | Rawlings | F01D 5/187 416/97 R |
| 2014/0093386 | A1* | 4/2014 | Pointon | F01D 5/20 416/95 |
| 2014/0096538 | A1 | 4/2014 | Boyer et al. | |
| 2014/0321961 | A1* | 10/2014 | Beattie | F01D 5/085 415/1 |
| 2015/0308449 | A1 | 10/2015 | Bareiss | |
| 2020/0248565 | A1* | 8/2020 | Banks | F01D 5/20 |
| 2020/0325780 | A1* | 10/2020 | Davis | F01D 5/187 |

OTHER PUBLICATIONS

Search Report dated Jul. 23, 2020 issued in European Patent Application No. 20 16 1689.3.
Office Action dated Oct. 18, 2021 issued in German Patent Application No. 10 2019 108 811.9.
Office Action issued in the counterpart Israeli Patent Application No. 272567.

* cited by examiner

MOVING BLADE OF A TURBO MACHINE

BACKGROUND OF INVENTION

1, Field of the Invention

The invention relates to a moving blade of a turbo machine.

2. Description of Related Art

Turbo machines, such as turbines or compressors, comprise stator-side assemblies and rotor-side assemblies. The rotor-side assemblies of a turbo machine include the turbo machine rotor, which comprises a hub body and, emanating from the hub body, moving blades extending radially to the outside. A moving blade of a turbo machine comprises a flow-conduction blade leaf and a blade root, via which the moving blade can be mounted in the hub body of the turbo machine. The moving blade of the turbo machine comprises a flow leading edge, a flow trailing edge, and flow conducting faces for a process medium extending between the flow leading edge and the flow trailing edge, which can also be referred to as suction and pressure side. The blade root, via which the moving blade can be mounted in the hub body of the turbo machine, is typically formed fir tree-like with at least two projections spaced apart from one another seen in the radial direction of the moving blade. A moving blade also comprises an inner shroud, which is arranged, seen in the radial direction of the moving blade, between the blade leaf and the blade root. If appropriate, an outer shroud can also adjoin the blade leaf radially outside. In particular in the region of turbines in which a hot process medium flows via the turbo machine, moving blades are employed in which a cooling passage is integrated. There, the cooling passage extends both over the blade root and also over the blade leaf. An inlet of the cooling passage is formed on the blade root radially inside. An outlet of the cooling passage can be formed on the blade leaf radially outside or on the radially outer shroud or in another location.

Although cooled moving blades with a cooling passage, which is integrated in the moving blade, are generally known, there is a need for further improving the cooling of a moving blade, namely with a high strength of the moving blade at the same time.

SUMMARY OF THE INVENTION

Starting out from this, one aspect of the present invention is a new type of moving blade of a turbo machine which, despite cooling passage, is of high strength.

According to one aspect of the invention, the inlet of the cooling passage is formed of a first inlet passage portion and a second inlet passage portion which, seen in the axial direction of the blade root, is arranged behind the first inlet passage portion, between which a material web extends. The first inlet passage portion of the cooling passage and the second inlet passage portion of the cooling passage merge into a unifying passage portion of the cooling passage, which seen in the radial direction is arranged radially outside or radially above the uppermost or radially outermost projection of the blade root and radially inside or radially below the inner shroud. This serves for the effective cooling of the moving blade with high strength of the moving blade at the same time.

Preferentially, the first inlet portion passage portion and the second inlet passage portion run from radially inside to radially outside initially rectilinearly in the radial direction. In that region of the blade root, in which the first inlet passage portion and the second inlet passage portion run rectilinearly in the radial direction an axial thickness of the material web is constant. This serves for the effective cooling of the moving blade with high strength of the moving blade at the same time.

The first inlet passage portion and the second inlet passage portion adjoining thereon run in the direction of the unifying passage portion in each case bent or curved, namely in the direction to a, based on the process medium flow, upstream or axially front end of the blade root. In that region of the blade root, in which the first inlet passage portion and the second inlet passage portion run bent or curved in each case, an axial thickness of the material web preferentially decreases in the direction of the unifying passage portion. This also serves for the effective cooling of the moving blade with high strength of the moving blade at the same time.

According to an advantageous further development, the first inlet passage portion is curved, in the direction of the upstream or axial front end of the blade root, with a first curvature radius. The second inlet passage portion is curved in the direction of the upstream or axially front end of the blade root with a second curvature radius. The first curvature radius is at least as large, preferentially larger than the second curvature radius. These features also serve for ensuring an effective cooling with high strength of the moving blade at the same time. According to an advantageous further development, the cooling passage, adjoining the unifying passage portion, initially extends to radially outside in the direction of a radially outer deflection passage portion. Adjoining the radially outer deflection passage portion, the cooling passage extends to radially inside in the direction of a radially inner deflection passage portion. Adjoining the radially inner deflection passage portion, the cooling passage extends to radially outside in the direction of a cooling passage outlet. The radially inner deflection passage portion is arranged in the radial direction above or radially outside of the uppermost or radially outermost projection of the blade root and below or radially inside of the inner shroud. This also serves for the effective cooling of the moving blade with high strength of the same.

According to an advantageous further development, the first inlet passage portion and the second inlet passage portion have same flow cross sections, which ensures an effective cooling of the moving blade.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

Figure 1:
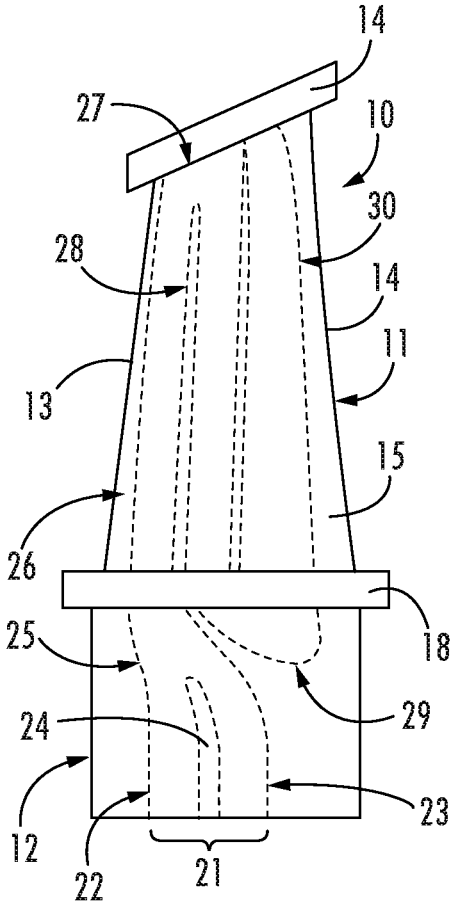
FIG. 1 is a lateral view of a moving blade of a turbo machine.
Figure 2:
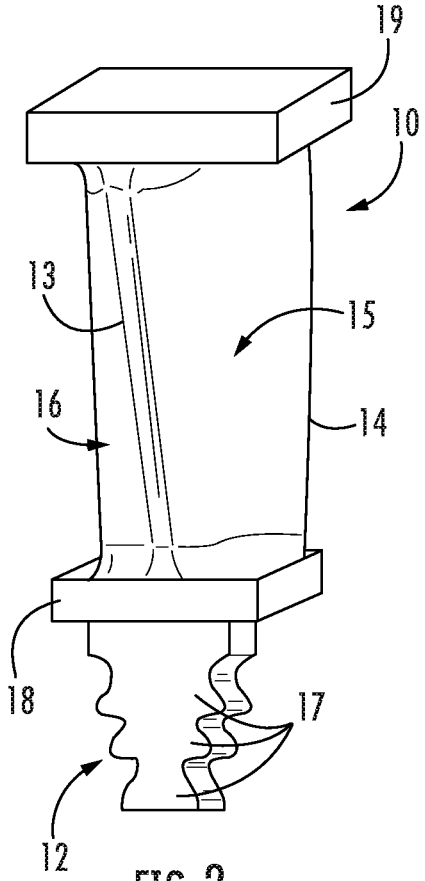
FIG. 2 is a perspective front view of the moving blade.

FIGS. 1 and 2 show views of a moving blade 10, wherein the moving blade 10 comprises a flow-conducting blade leaf 11 and a blade root 12. The flow-conducting blade leaf 11 serves for the flow conduction of a process medium, in particular of process gas, which flows through the turbo machine, wherein the blade leaf 11 comprises a flow leading edge 13 for the process medium, a flow trailing edge 14 for the process medium and flow conduction faces 15, 16 for the process medium extending between the flow leading edge 13 and the flow trailing edge 14. The flow conduction faces 15, 16 form a suction side and a pressure side.

The blade root 12 serves for mounting the moving blade 10 in a hub body of the turbo machine which is not shown. The blade root 12 is formed fir tree-like with at least two projections 17 spaced apart from one another seen in the radial direction of the moving blade 10. In the shown exemplary embodiment, three such projections 17 are spaced apart from one another in the radial direction of the moving blade 10. Between adjacent projections 17, the fir-tree profile of the blade root 12 tapers in each case. A projection 17 each and the tapering portion of the fir-tree profile arranged directly above the respective projection 17 each define a so-called tooth of the fir-tree profile.

The moving blade 10, furthermore, comprises an inner shroud 18, which is arranged seen in the radial direction of the moving blade 10, between the blade leaf 11 and the blade root 12 of the moving blade 10. The inner shroud 18 delimits a flow conduction passage for the process medium radially inside. In the shown exemplary embodiment, the moving blade 10 furthermore comprises an outer shroud 19. The outer shroud 19 delimits the flow conduction passage for the process medium radially outside.

Figure 3:
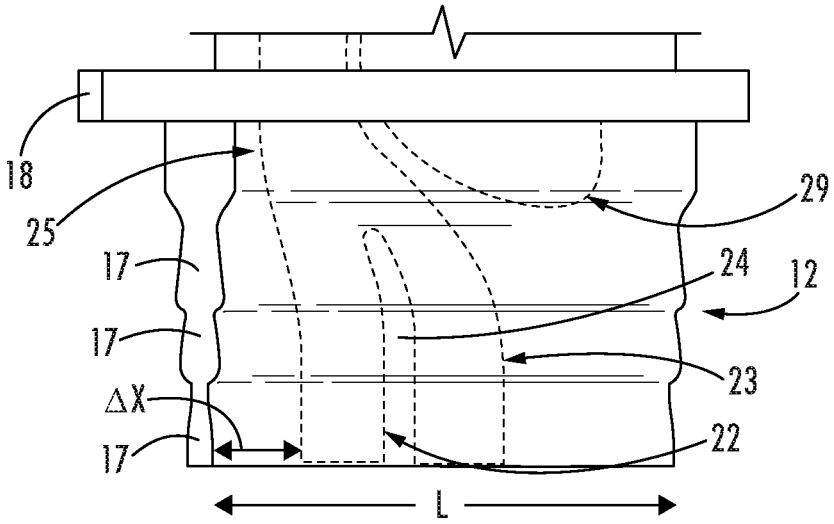
FIG. 3 is a detail of the moving blade in a region of a blade root.
Figure 5:
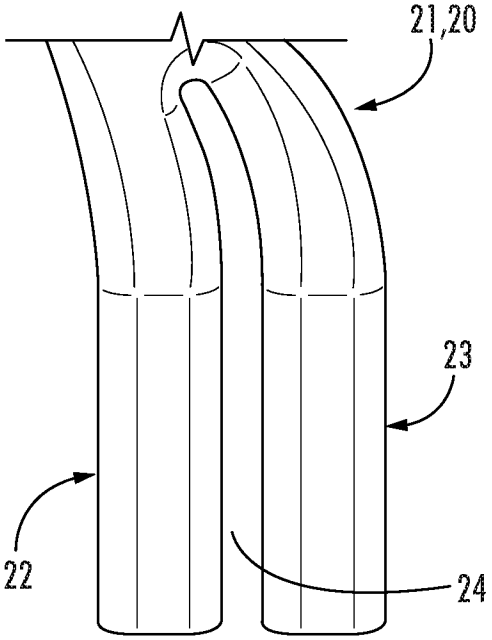
FIG. 5 is an extract V of FIG. 5.
Figure 4:
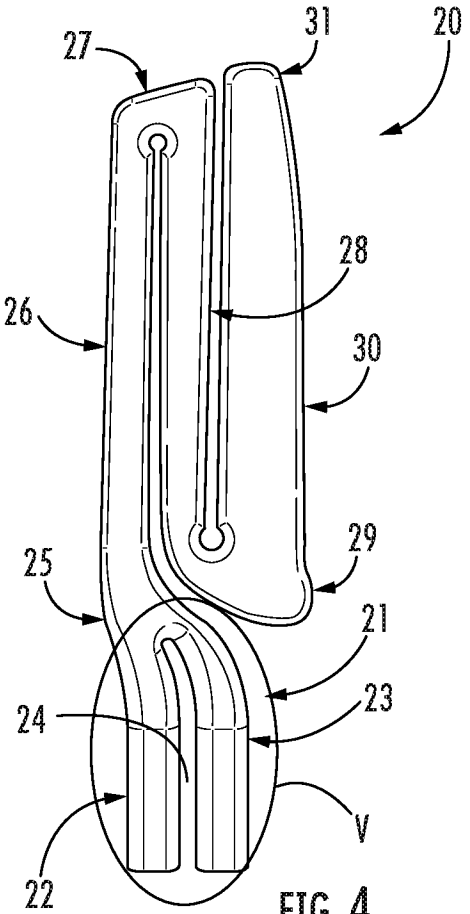
FIG. 4 are contours of a cooling passage of the moving blade.

A cooling passage 20 for cooling medium, in particular cooling air, is integrated in the moving blade 10. In FIG. 1, contours of the cooling passage 20 are shown in dashed lines. Contours of the cooling passage 20 are also shown in dashed lines in certain sections in FIG. 3. FIGS. 4, 5, 6 and 7 merely show the contours of the cooling passage 20 without the actual moving blade 10.

The cooling passage 20 comprises an inlet or cooling passage inlet 21, which is formed on the blade root 12 radially inside. Furthermore, the cooling passage 20 comprises an outlet or cooling passage outlet 31, which is formed in particular on the blade leaf 11 radially outside or on the outer shroud 19. The cooling passage outlet 31 can also be positioned in another location.

FIGS. 3, 5, 6 and 7 show details of the inlet or cooling passage inlet 21 of the cooling passage 20.

The inlet or cooling passage inlet 21 of the cooling passage 20 comprises a first inlet passage portion 22 and a second inlet passage portion 23. As is best evident from FIG. 1, the first inlet passage portion 22 is positioned, seen in the axial direction, based on the flow of the process medium, at the front, i.e. positioned nearer to a, based on the process medium flow, upstream or axially front end of the blade root 12 than the second inlet passage portion 23.

The second inlet passage portion 23 is arranged seen in the axial direction of the blade root 12 behind the first inlet passage portion 22.

As already explained, the blade root 12 does not serve for the process medium conduction but merely for mounting or assembling the moving blade 10 on the hub body. Nevertheless, the blade root 12 comprises two axial ends located opposite one another, based on the process medium flow, an upstream or axially front end and a downstream or axially rear end.

The first inlet passage portion 22 is arranged between the upstream or axially front end of the blade root 12 and the second inlet passage portion 23.

The second inlet passage portion 23 is arranged between the first inlet passage portion 22 and the downstream or axially rear end of the blade root 12.

Between the two inlet passage portions 22 and 23, which are spaced apart from one another in the axial direction of the blade root 12, a material web 24 extends. This material web 24 stiffens the moving blade 10 in the region of its blade root 12.

The first inlet passage portion 22 and the second inlet passage portion 23 of the cooling passage 20 merge into a connecting passage portion 25.

This connecting passage portion 25 is arranged or formed, seen in the radial direction of the moving blade 10, above or radially outside of the uppermost or radially outermost projection 17 and below or radially inside the inner shroud 18.

The material web 24 extends from radially inside to radially outside as far as into a portion of the blade root 12 arranged above or radially outside of the radially outermost and thus uppermost projection 17 of the blade root 12, as a result of which the strength of the moving blade 10 can be particularly advantageously adjusted in the region of the blade root 12. Preferably, the material web 24 extends as far as into the region of the narrowest cross section of the radially outermost and thus uppermost tooth of the fir-tree profile of the blade root 12.

Radially inside on the blade root 12, the first inlet passage portion 22 defines a first flow inlet opening and radially inside on the blade root 12, the second inlet passage portion 23 defines a second flow inlet opening. Just like the inlet passage portions 22, 23 themselves, the flow inlet openings are positioned, seen in the axial direction of the blade root 12, behind one another and spaced apart from one another by way of the material web 24.

The first flow inlet opening and thus the first inlet passage portion 22 has a defined axial distance $\Delta x$ from the, based on the process medium flow, upstream or axially front end of the blade root 12. Preferably, the defined axial distance $\Delta x$ between the first inlet passage portion 22 and thus the first flow inlet opening and the upstream or axially front end of the blade root 12 amounts to between 10% and 30%, in particular between 15% and 25% of the axial length L of the blade root 12.

As is best evident from FIGS. 4, 5, 6, and 7, the first inlet passage portion 22 and the second inlet passage portion 23, emanating from their respective flow inlet opening, i.e. emanating from radially inside, initially run rectilinearly in the radial direction to radially outside. In this region, in which the two inlet passage portions 22, 23 run rectilinearly in the radial direction, the material web 24 has a constant thickness in the axial direction. The axial distance $\Delta x$ defined above between the first inlet passage portion 22 and the upstream end of the blade root 12 relates to the region of the first inlet passage portion 22 running rectilinearly in the radial direction to radially outside. Adjoining that region in which the two inlet passage portions 22, 23 run rectilinearly in the radial direction, the two inlet passage portions 22, 23 run bent or curved in the direction of the connecting passage portion 25. In the region of this curvature, the distance $\Delta x$ defined above changes. The curvature of the inlet passage portions 22, 23 between the regions of the same running rectilinearly in the radial direction and the connecting passage portion 25 is directed in the direction of the upstream or axially front end of the blade root 12 or in the direction of the flow leading edge 13 of the moving blade 11. In this region, in which the two inlet passage portions 22, 23 that are separated from one another via the material web 24 run bent or curved, the axial thickness of the material web 24 preferentially decreases in the direction of the unifying passage portion 25. In this region, the material web 24 tapers. Alternatively, the axial thickness of the material web 24 can also be constant in this region.

Adjoining the connecting passage portion 25, the cooling passage 20 in the shown exemplary embodiments extends with a further portion 26 initially to radially outside in the direction of a radially outer deflection passage portion 27, adjoining the radially outer deflection passage portion 27, with a further portion 28 to radially inside in the direction of an inner deflection passage portion 29 and adjoining this radially inner deflection passage portion 29, with a further portion 30 to radially outside in the direction of the cooling passage outlet 31. The portion 26, 28 and 30 of the cooling passage 20 extend within the blade leaf 11. Other courses of the cooling passage 20 downstream of the connecting passage portion 25 are also possible.

The radially inner deflection passage portion 29 is arranged seen in the radial direction above or radially outside of the uppermost or radially outermost projection 17 of the blade root 12 and below or radially inside of the inner shroud 18, namely in the axial direction opposite the inlet passage portions 22, 23 offset axially to the back in the direction of the downstream or axially rear end of the blade root 12.

The upper or radially outer deflection passage portion 27 can extend into the region of the outer shroud 19.

With the moving blade 10 according to one aspect of the invention, cooling medium accordingly flows via the flow inlet openings of the inlet passage portions 22, 23 into the cooling passage 20, wherein this coolant flowing via the two inlet passage portions 22, 23 is unified in the region of the unifying passage portion 25. This takes place in the region of the blade root 12. Adjoining this, the cooling medium is conducted via the passage portions 26, 27, 28, 29 and 30 in the direction of the cooling passage outlet 31.

The passage portions 26, 28, and 30 extending in the radial direction, extend over the radial extension of the blade leaf 11. Between the passage portions 26, 28 and between the passage portions 28 and 30, a flow deflection occurs via the deflection passage portions 27 and 29.

Figure 7:
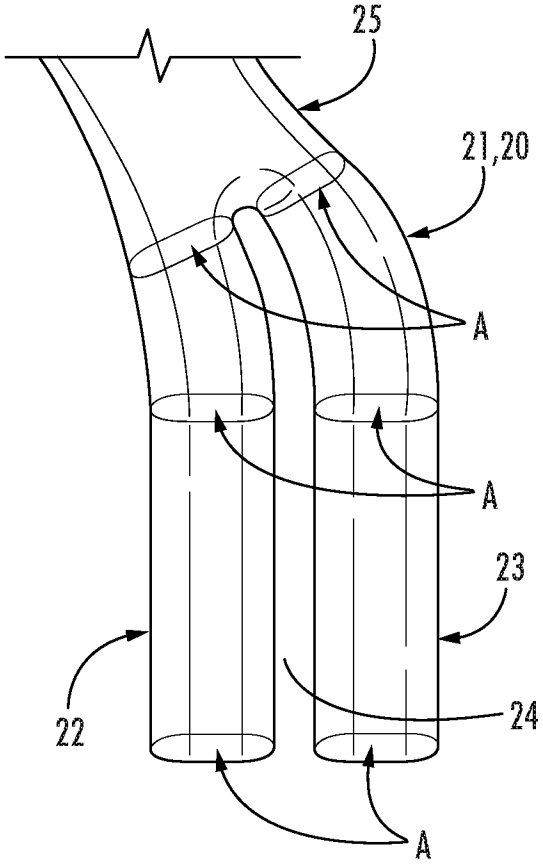
FIG. 7 is an extract V of FIG. 4 with further geometrical quantities.
Figure 6:
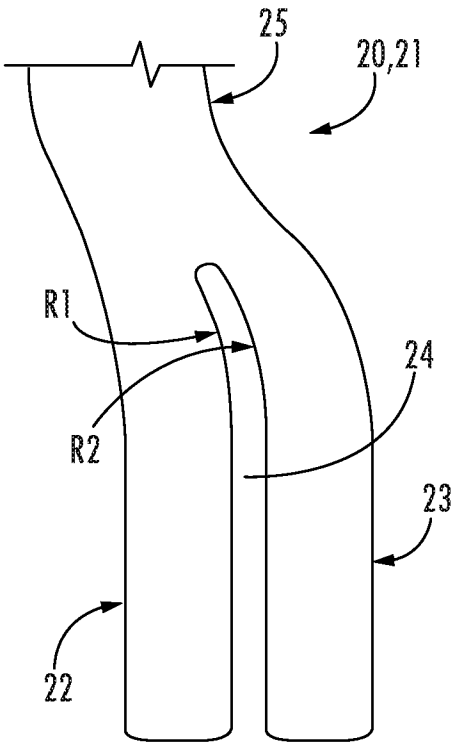
FIG. 6 is an extract V of FIG. 4 with geometrical quantities.

FIGS. 6 and 7 show geometrical characteristic variables of the flow passage 20 in the region of the cooling passage inlet 21. Thus it is evident from FIG. 6 that the first inlet passage portion 22 is curved with a first curvature radius R1 and the second inlet passage portion 23 with a second curvature radius R2 in the direction of the upstream axial end of the blade root 12. The first curvature radius R1 is at least as large as the second curvature radius R2, preferentially R1 is larger than R2.

FIG. 7 shows the flow cross sections of the inlet passage portions 22 and 23. From FIG. 7 it is evident that the two inlet passage portions 22 and 23 have a same flow cross sections A, namely over their entire radial extent as far as to the unifying passage portion 25.

In the moving blade 10 according to one aspect of the invention, cooling medium in the region of the inlet passage portions 22, 23 can directly enter the cooling passage 20 in the radial direction, as a result of which an effective entry of the cooling medium into the cooling passage 20 is possible. Seen in the axial direction, the inlet passage portions 22, 23, which are spaced apart from one another in the axial direction, have a defined axial distance from the upstream end of the blade root 12. Furthermore, the inlet passage portions 22, 23 are spaced apart from one another by the material web 24 in the axial direction, which serves for provides a high strength of the moving blade 10 in the region of the blade root 12. The web 24 extends seen in the radial direction as far as to above or radially outside of the uppermost or radially outermost projection 17 of the fir tree-like blade root 12, which ensures an optimum strength in the region of the blade root 12.

In the radial region of the blade root 12, in which the two inlet passage portions 22 and 23 merge into the unifying passage portion 25, the radially inner deflection passage portion 29, axially spaced apart from the unifying passage portion 25, is also arranged. This radially inner deflection passage portion 29 extends into the blade root 12 but terminates, spaced apart from the radially outermost projection 17 of the fir tree-like blade root 12, radially outside or radially above the web 24. The moving blade 10 according to the invention allows an optimum cooling with high strength. It is employed in particular in gas turbines.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A moving blade of a turbo machine, comprising:

a blade leaf having:

a flow leading edge;

a flow trailing edge; and flow conduction faces extending between the flow leading edge and the flow trailing edge;

a blade root that is fir tree-like shaped that narrows in width as the blade root progresses radially inward with at least two projections spaced apart from one another seen in a radial direction and having an entire radially inner facing blade root surface is planar and configured to mount the moving blade to a hub body of the turbo machine, wherein the entire radially inner facing planar surface is bounded by an outer perimeter of the blade root;

an inner shroud radially arranged between the blade leaf and the blade root;

a single cooling passage is integrated in the blade leaf and the blade root;

an inlet of the cooling passage is formed on the radially inner facing planar surface of the blade root having:

a first inlet passage portion;

a second inlet passage portion arranged behind the first inlet passage portion in an axial direction;

a first material web extends between the first inlet passage portion and the second inlet passage portion, the first material web being a portion of the radially inner facing planar surface of the blade root;

a second uninterrupted material web extends between the flow leading edge and the first inlet passage portion, the second material web being a portion of the radially inner facing planar surface of the blade root;

a third uninterrupted material web extends between the second inlet passage portion and the flow trailing edge, the third material web being a portion of the radially inner facing planar surface of the blade root; and a unifying passage portion of the cooling passage into which the first inlet passage portion and the second inlet passage portion merge arranged radially outside or radially above an uppermost or radially outermost projection of the blade root and radially inside or radially below the inner shroud, wherein the a first inlet passage portion and the second inlet passage portion each have a same flow cross section over their entire radial extent from the planar blade root to the unifying passage portion;

wherein the first inlet passage portion of the cooling passage and the second inlet passage portion of the cooling passage run from radially inside to radially outside;

wherein the first inlet passage portion and the second inlet passage portion adjoining thereon run in each case bent or curved in a direction of the unifying passage portion of the cooling passage, which based on a process medium flow is upstream or an axially end of the blade root;

wherein the first inlet passage portion in an upstream direction of an axially front end of the blade root is curved with a first curvature radius;

wherein the second inlet passage portion in the direction of the upstream direction or the axially front end of the blade root is curved with a second curvature radius; and wherein the first curvature radius is at least as large as the second curvature radius.

2. The moving blade according to claim 1, wherein the first inlet passage portion defines a first flow inlet opening and the second inlet passage portion defines a second flow inlet opening, which is positioned axially behind the first flow inlet opening in an axial a direction of the blade root.

3. The moving blade according to claim 2, wherein the first inlet passage portion and the first flow inlet opening has a defined axial distance from an axially front end of the blade root based on a process medium flow.

4. The moving blade according to claim 3, wherein the defined axial distance between the first inlet passage portion and the first flow inlet opening and the axially front end of the blade root is between 10% and 30% of an axial length of the blade root.

5. The moving blade according to claim 1, wherein the first inlet passage portion of the cooling passage and the second inlet passage portion of the cooling passage run initially rectilinearly in the radial direction.

6. The moving blade according to claim 5, wherein in that region in which the first inlet passage portion and the second inlet passage portion run rectilinearly in the radial direction, an axial thickness of the material web is constant.

7. The moving blade according to claim 5, wherein in that region in which the first inlet passage portion and the second inlet passage portion run bent or curved in each case, an axial thickness of the material web decreases in a direction of the unifying passage portion.

8. The moving blade according to claim 5, wherein in that region in which the first inlet passage portion and the second inlet passage portion run bent or curved in each case, an axial thickness of the material web is constant.

9. The moving blade according to claim 1, wherein the cooling passage extends radially outside adjoining the unifying passage portion.

10. The moving blade according to claim 1, wherein adjoining the unifying passage portion the cooling passage initially extends radially outside in a direction of a radially outer deflection passage portion, and adjoining this, the cooling passage extends to radially inside in the direction of a radially inner deflection passage portion, and adjoining this, the cooling passage extends to radially outside in a direction of a cooling passage outlet.

11. The moving blade according to claim 10, wherein the radially inner deflection passage portion is arranged in the radial direction radially outside or radially above the uppermost or radially outermost projection of the blade root and radially inside or radially below the inner shroud.

12. The moving blade according to claim 1, wherein a cooling passage outlet is formed on a radially outside portion of the blade leaf.

13. The moving blade according to claim 1, wherein a cooling passage outlet is formed on an outer shroud that delimits the flow conduction passage radially outside.

14. The moving blade according to claim 1, wherein a cooling passage outlet is formed on a radially outer end of the blade leaf.

* * * * *